US007905820B2

(12) United States Patent
Druitt

(10) Patent No.: US 7,905,820 B2
(45) Date of Patent: Mar. 15, 2011

(54) CLOSURE

(75) Inventor: Rodney Druitt, Cheltenham (GB)

(73) Assignee: Creanova Universal Closure Ltd. (GB)

( * ) Notice: Subject to any disclaimer, the term of this patent is extended or adjusted under 35 U.S.C. 154(b) by 333 days.

(21) Appl. No.: 11/574,565

(22) PCT Filed: Apr. 8, 2005

(86) PCT No.: PCT/EP2005/051575

§ 371 (c)(1),
(2), (4) Date: Aug. 15, 2008

(87) PCT Pub. No.: WO2006/024550

PCT Pub. Date: Mar. 9, 2006

(65) Prior Publication Data

US 2008/0314000 A1 Dec. 25, 2008

Related U.S. Application Data

(60) Provisional application No. 60/606,240, filed on Sep. 1, 2004.

(51) Int. Cl.
*B65D 55/02* (2006.01)

(52) U.S. Cl. ..... 493/114; 493/84; 215/343; 215/344; 215/354; 215/252

(58) Field of Classification Search ..... 493/52, 493/84, 114, 121; 214/344, 343, 252, 341, 214/354; 215/344, 343, 252, 341, 354
See application file for complete search history.

(56) References Cited

U.S. PATENT DOCUMENTS

| | | | | | |
|---|---|---|---|---|---|
| 3,441,161 | A | * | 4/1969 | Van Baarn | 215/235 |
| 4,442,947 | A | * | 4/1984 | Banich, Sr. | 215/344 |
| 4,489,845 | A | | 12/1984 | Aichinger et al. | |
| 4,519,514 | A | * | 5/1985 | Agbay et al. | 215/225 |
| 4,546,892 | A | * | 10/1985 | Couput | 215/252 |
| 4,560,077 | A | | 12/1985 | Dutt | |
| 4,598,835 | A | | 7/1986 | Brownbill | 215/307 |
| 4,646,926 | A | * | 3/1987 | Agbay et al. | 215/203 |
| 4,899,897 | A | * | 2/1990 | Buttiker et al. | 215/228 |
| 4,907,709 | A | | 3/1990 | Abe et al. | |
| 5,423,444 | A | | 6/1995 | Druitt | |
| 5,478,337 | A | * | 12/1995 | Okamoto et al. | 604/413 |
| 5,678,718 | A | * | 10/1997 | Morris et al. | 220/254.1 |
| 5,782,369 | A | | 7/1998 | Tansey | 215/344 |

(Continued)

FOREIGN PATENT DOCUMENTS

AU 15456/76 1/1978

(Continued)

OTHER PUBLICATIONS

International Search Report PCT/EP2005/051575 dated Jul. 5, 2005 (European Patent Office).

(Continued)

*Primary Examiner* — Christopher Harmon

(57) ABSTRACT

The invention concerns a closure for sealing of an orifice of a neck of a container. The closure comprises a top portion, an outer skirt and a sealing means. The sealing means comprises an outer sealing means suitable to be engaged with an outer free peripheral surface of neck. The outer sealing means comprises an annular base radially distanced to said outer skirt and at least one annular sealing ring protruding radially inwardly over said base.

16 Claims, 8 Drawing Sheets

U.S. PATENT DOCUMENTS

| | | | | |
|---|---|---|---|---|
| 6,695,161 | B2 | 2/2004 | Kano et al. | |
| 2001/0027957 | A1 | 10/2001 | Kano | 215/341 |
| 2002/0158037 | A1 | 10/2002 | Kano et al. | 215/341 |

FOREIGN PATENT DOCUMENTS

| | | | |
|---|---|---|---|
| AU | 14180/83 | | 11/1983 |
| CN | 1071135 | | 4/1993 |
| CN | 1027532 | C | 2/1995 |
| CN | 1221386 | | 6/1999 |
| CN | 2438673 | | 7/2001 |
| DE | 31 39 526 | | 4/1983 |
| EP | 0076778 | | 4/1983 |
| EP | 0093690 | | 11/1983 |
| GB | 788148 | | 12/1957 |
| JP | 58-73551 | | 5/1983 |
| WO | WO 89/12584 | A | 12/1989 |
| WO | WO 97/38912 | | 10/1997 |

OTHER PUBLICATIONS

English translation of Japanese Office Action dated Feb. 6, 2009 corresponding to Japanese Patent Application No. 200580035569.0.

* cited by examiner

CLOSURE

CROSS REFERENCE TO RELATED APPLICATION

The present application is a 35 U.S.C. §371 national phase conversion of PCT/EP2005/051575 filed 8 Apr. 2005, which claims priority of U.S. Provisional Patent Application No. 60/606,240 filed 1 Sep. 2004, which is herein incorporated by reference. The PCT International Application was published in the English Language.

BACKGROUND OF THE INVENTION

1. Field of the Invention

The invention relates to a closure for a container for liquids such as beverages, especially carbonated beverages. In particular the invention provides a screw top cap which seals bottles of carbonated liquid such as soft drinks but is well adapted to seal other containers such as glass or PET containers with contents at above or below atmospheric pressure or having gaseous components or requiring a hermetic seal. Depending on the field of application the closure may comprise a hinge.

2. Description of the Art

Various screw top closures for containers made out of a plastic material, such as polyethylene terephthalate or other materials such as glass are known from prior art. The neck of the containers for these closures are in general standardized and comprise a nearly cylindrical neck portion with an external thread on an outer peripheral surface. An upper end part of the neck portion, positioned above the external thread, has an annular top surface extending substantially horizontally when the bottle is standing upright. A cylindrical outer peripheral surface and a cylindrical inner peripheral surface are extending substantially vertically from the annular top portion. Although many screw tops include a separate sealing gasket within the cap, there is substantial advantage to be had in producing a one-piece cap which avoids the separate sealing gasket.

A one piece cap is shown in the British patent GB788148 (1957), Maxwell, which includes a continuous lip within the top portion of the cap positioned to engage against the annular end face of the opening of the neck of the container and provide a seal between the lip and the free end edge of the neck of the container with the lip curling over at its free edge. However, this cap provides a seal only against the free end edge of the container.

Australian patent application AU15456/76 (1976), Obrist et al., discloses a one-piece cap in which an annular lip extends from the inside top of the cap and engages the inner bore of a container opening so as to curl the free end of the lip in against the bore or inside surface of the opening. However, with this cap, effective sealing requires the inside bore of the opening to be of accurate and consistent dimensions. Furthermore, if carbonated or other gaseous liquid is to be contained, gas pressure will tend to distort the lip and cause a seal failure.

Australian patent application AU14180/83 (1983), Aichinger, describes a cap with two internal sealing structures. One of the structures is an annular shaped outer portion shaped to accept the outer peripheral edge of the free end of the container relying upon the pressure generated during the closing of the cap to seal against this outer edge. Further provided is an inner cylindrical lip to engage the inner bore of the container opening.

U.S. Pat. No. 6,695,161 (2001), Kano et al., is directed to a closure for liquids, especially carbonated beverages, with a seal which shall avoid leaking of the closure because of deformation (doming) due to high internal pressure. However, one draw back of this closure is that it works only in connection with bottles having a special neck portion differing from the above described standardized neck of containers, i.e. wherein the annular top surface and the cylindrical outer peripheral surface of the neck portion must be connected together via an annular boundary surface extending substantially arcuately over a considerable length in a sectional view. Therefore this closure is not suitable for standardized bottles as they are in extensive use on different markets. The seal of the closure described in US'161 comprises an annular seal piece, an annular contact piece and an annular positioning piece which are formed in an outer peripheral edge portion of the inner surface of the top panel wall of the closure. The annular seal piece extends downwardly obliquely in a radially inward direction from the inner surface of the top panel wall and has an outer peripheral surface extending downwardly in a radially inward direction at an inclination angle of about 20°. The annular contact piece is situated immediately inwardly of the annular seal piece and is bulging downwardly in a convex form from the inner surface of the top panel wall. The annular positioning piece is located radially inward arranged at a distance from the contact piece and extends downward substantially vertically from the inner surface of the top panel wall.

U.S. Pat. No. 5,423,444 (1995), Druitt, is directed to a one-piece plastic closure for a container having an externally screw threaded neck as described above. The closure comprises a top portion and an internally threaded skirt and an annular bent sealing rib which projects downwardly from the inside of the top portion. The sealing rib includes a first substantially cylindrical portion contiguous with the top and lying adjacent to or abutting with the skirt and a second, frusto-conical portion contiguous with the end of the first portion distal to the top and extending radially inwardly to terminate in a circular free edge. During threaded engagement of the closure with the neck, the second, frusto-conical portion is engaged by a free end of the neck and folded back against the first, substantially cylindrical portion of the rib to form a gas-tight seal between the neck of the container and the closure.

EP0076778 (1982), Blaser et al., discloses a closure with a circular sealing lip which is arranged in the region of the edge between the outer skirt of the closure and the circular top wall and points obliquely inwards. The sealing lip is made such that it interacts with the outer surface of the neck of the container. At its smallest diameter the sealing lip has a rounded sealing portion and below the sealing portion the sealing lip is widened outwards in the manner of a funnel to receive a container opening. While receiving a container neck the sealing lip rotates about a fulcrum which is located at the base of the sealing lip. The thickness of the sealing lip is in general constant over it's entire length. Due to the oblique arrangement and the thickness of the sealing lip significant resistance has to be overcome while applying the closure to the neck of a container.

EP0093690/U.S. Pat. No. 4,489,845 (1982), Alchinger et al., is directed to a screw-cap with a sealing lip which is affixed to the cap top. The inner side-wall of the sealing lip has a diameter which is greater than the outer diameter of the container opening. The closure further comprises a skirt like clamping device which reaches into the opening of the container neck when the closure is arranged on the neck of the container. This clamping device may itself be designed as an inner seal. According to the description this clamping device creates a contraction of the cap top when the closure is screwed on the neck of a container such that the sealing lip, which is arranged on the outside, is pressed against the container mouth. One problem of this closure is that the described contraction of the whole closure does not significantly occur as described and that the seal is susceptible to imprecision of the neck of the container. A further problem is that this closure needs high torque to proper seal.

U.S. Pat. No. 4,907,709 (1990), Abe et al., describes a combination of a bottle and a closure. The closure has a top wall and a side wall with a thread on the inner surface corresponding to a thread on the outer surface of the neck of the bottle. The closure has an annular shoulder on the inner surface of the top wall thereof which is engageable with the upper surface of the bottle neck and with the outer surface of the bottle neck. An annular rib protruded downward from the top wall of the closure at a place inside of the shoulder to be resiliently engageable with the inner surface of the side wall of the bottle neck. The outer seal of this closure is designed very short and bulky. Due to that it does not provide sufficient flexibility which is necessary to adjust lateral distortion of the neck of the bottle.

All above described closures are injection/compression moulded. With this type of products the sale's price is directly related to the amount of material necessary per closure and the cycle time for injection moulding. Therefore it is advantageous when a closure needs less material and can be produced at lower cycle time such that more closures may be produced.

A problem with the closures known from prior art is that they often fail while being applied to a container by a capping machine at high speed. It often happens that the seal, the thread or the tamper evidence means take damage due to tilted application of the closure on the neck of the container. A further problem is that the closure is ruptured due to external forces. Therefore a good closure should not only use less material and must be produced at high speed it furthermore should also have sufficient mechanical strength to withstand large external handling forces. A good closure further comprises centering means which avoid tilted application of the closure on the neck.

A further problem closures from prior art often suffer is that at high internal pressure of the container the seal fails and content leaks due to doming or lift-off of the top portion of the cap. Especially with caps which seal primarily on the inner peripheral surface or on the annular top surface of the neck of the container this problem may occur.

A still further problem often occurring with closures known from prior art is leakage of the seal due to high internal pressure in the container and additional top load applied to the top of the closure, e.g. due to stacking of several containers. The reason for this can be found in deformation of the closure and therewith related displacement of the seal.

It is an object of the present invention to provide an improved closure suitable for carbonated beverages and other hot or cold liquids, to offer advantages in production such as low cycle time and less material consumption and to be still pressure tight at high internal pressures and top load.

SUMMARY

The closure according to the present invention is suitable to be engaged with containers comprising a standardized neck. The standardized neck of the container comprises a cylindrical neck portion with an external thread on an outer peripheral surface. An upper end part of the neck portion, positioned above the external thread, has an annular top surface extending substantially horizontally when the container is standing upright. Furthermore the neck of the container comprises a cylindrical, inner peripheral surface adjacent to the annular top surface. Between the annular top surface and the thread a free vertical surface extends over a length of approximately 1 mm to 3 mm of the neck which is not covered by the thread.

The closure according to the present invention comprises a disc like top portion and a therewith adjacent outer skirt with retaining means here in the form of an internal thread suitable to be engaged with corresponding retaining means such as an external thread of the standardized neck of a container as described above. The closure further comprises a sealing means which preferably interacts with the outer thread-free peripheral cylindrical surface arranged between the thread and the annular top surface of the neck. The functional importance of this interaction will be described in more detail further below.

Preferably the plastics material of the closure is high density polyethylene, low density polyethylene, polypropylene or a combination thereof. Where the container is to be used for gaseous liquids, the plastics material preferably has a very low porosity to the gas.

Conventional closures as known from prior art often suffer the disadvantage that they fail due to top load or doming of the disc-like top portion of the closure. Conventional closures in general comprise a sealing means which interacts with the cylindrical inner peripheral surface and/or the annular top surface (and it's edges) of the neck of the container. Due to doming of the closure and their rigidity these conventional sealing means are lifted off in a way such that the closure may start to leak and fails.

The sealing means of the present closure comprises an essentially cylindrical inner skirt arranged inside the outer skirt in general extending perpendicular from the annular top surface into the closure radially distanced to the outer skirt by a gap having a defined with and depth. The inner skirt, which in general has with respect to ifs cross section the form of a free standing downward leg, is at its base preferably interconnected directly to the top portion of the closure. In the area of its opposite lower free end the inner skirt turns into at least one toroidal sealing ring which interacts in closed position radially from the outside with the outer free surface of the neck of the container via a designated contact surface, whereby this contact surface is arranged preferably as far down onto the free surface of the neck of the bottle as possible to reduce influence of known problems, e.g. doming, bottle finish damage at the upper outside rim, lifting of closure which might occur. The at least one toroidal sealing ring is preferably shaped such that it seals primarily due to annular tension. Therefore the sealing means is preferably freestanding even in radially deformed position when applied onto the neck of a container. In a preferred embodiment the gap between the inner and the outer skirt is designed such that no contact occurs at any time between the sealing means and the outer skirt at any time. However, controlled lateral support may be appropriate as will be explained later on.

The toroidal sealing ring comprises a protrusion which is arranged in engaged position towards the neck of the container and defines a contact zone. In difference to seals known form prior art which act on the inside surface of the neck and therefore are mainly subject to annular pressure forces, the in general freestanding sealing means according to the present invention, which is hold primarily in the area of it's base, mainly seals due to annular tension forces occurring when applied onto the neck of a container. The sealing means is designed such that it is capable to adjust/compensate a certain amount of lateral and/or radial offset or distortion of the neck of the container. Therefore it comprises a base which provides a certain flexibility in lateral/radial direction. Good results are achieved in that the proportion ratio vertical length to radial thickness of the base of the sealing means, which is arranged between the top portion of the closure and the toroidal sealing ring, is at least 1:1 preferably 4:1. Depending on the field of application further aspect ratios are relevant such as the radial thickness of the base of the sealing means and the radial thickness of the annular sealing ring and the aspect ratio of the vertical length to the radial thickness of the annular sealing ring and the gap between the inner and the outer skirt. The aspect ratio of the vertical length of the annular sealing ring to its radial thickness mainly influences the annular tension in the annular sealing ring and the contact force between the annular sealing ring and the neck of a container. In a preferred embodiment the aspect ratio between the radial thickness of the annular sealing ring and the base is in the range of 2:1 and 3:1 (depending on the field of application other aspect ratios may be appropriate). The aspect ratio between the vertical free length of the annular sealing ring and its radial thickness is preferably in the range of 1:1 and 4:1. Depending of the field of application other aspect ratios are appropriate. The shape of the cross section of the annular sealing ring and the eccentricity of the contact surface with respect to the base of the sealing means is of further relevance for the field of application because these parameters influence the distribution of annular tension forces.

To avoid unwanted chips or damage of the sealing means, depending on the field of application, supporting ribs which are arranged in general in a radial direction may be present in the area of the gap between the inner and the outer skirt to radially and/or vertically support the base and/or the annular sealing ring of the sealing means and to adjust flexibility. The supporting ribs are preferably arranged radially in between the in general vertical skirt of the sealing means and the outer wall of the closure, vertically leading into the annular top surface and preferably arranged in a regular distance to each other. The supporting ribs are straight or bent depending on the type of support to be provided. Bent ribs are preferably used when the support of the supporting ribs needs to be, compared to straight ribs, more elastic especially in radial direction. The supporting ribs may be aligned to the thread of the closure to provide better demoulding of the closure. By the design, especially the shape of the cross-section, the lateral thickness and the height of the supporting ribs the strength and the sealing force of the sealing means may be adjusted alternatively. However, ribs may result in reduction of the lateral adjustability of the sealing means. In a preferred embodiment the height of the supporting ribs corresponds approximately to half of the height of the sealing means. If very rigid support of the sealing means is appropriate the gap between the outer skirt and the base of the sealing means may be at least partially filled up with elastic material. However, one disadvantage of this embodiment may result in that the lateral flexibility of the sealing means is not guaranteed anymore.

The shape and the alignment of the base of the sealing means is relevant for the performance and the physical behaviour of the sealing means. E.g. if the base of the sealing means is inclined (conically) at an angle with respect to the top of the closure, the pop on of the closure onto the orifice (opening) of the container becomes more difficult and failure due to mismatch are more likely. One reason for this is that the distribution of forces and the initial widening of the seal becomes more difficult.

The thread preferably used in connection with the sealing means of the herein disclosed invention is made such that failure of the seal due to mismatch of the closure while pop on to the neck of the container becomes more unlikely compared to closures known from prior art. In a preferred embodiment the thread consists out of segments wherefrom several segments are having an essentially frusto conical/prolate ellipsoidal bottom (lower end section which points in the direction of the opening of the closure) and an essentially conical shape at their top. The conical top shape is aligned to the pitch of the thread such that it interacts along its length with the thread of the neck of the container when engaged. To obtain good distribution of load it is advantageous that segments of the thread interact with the thread of the neck of the container two-dimensional. The effect of the frusto conical shape of the bottom of the segments is that during application of the closure onto the thread of the neck of the container the contact between the segments of the thread of the closure and the thread of the neck of the bottle occurs due to the specific bottom shape of the segments of the thread only at distinct interaction points which helps to stabilize the process. A further advantage is that drag during application is reduced. Looking at a radial cross section of a segment of the thread of the closure, the cross section comprises an essentially arch-shaped bottom and an essentially straight top which passes over into an essentially vertical inner side surface of the closure. The transitions from one segment of the cross section into another are preferably floating without sharp edges. The dilation of the cross sections of the segments of the thread is in general maximal about the middle of the length of each segment and is reduced versus its ends. At least one of the first (inlet of the thread) and the last (outlet of the thread) segments may have a shape which deviates from the shape of the other segments. Thereby the special conditions on the beginning and the end of the thread are considered.

The closure according to the present invention may have on its outside means which increase the traction while opening or closing the thread of the closure. Good results are achieved by knurls with a circular cross section which are arranged within the outer contour of the outer skirt of the closure. At the lower end of the knurls a thickening rim may be present which increases the stability of the closure in this area which might be important during ejection of the closure out of the mould.

Depending on the field of application the closure may consist out of several material components injected similarly or sequentially into a mould. In a preferred embodiment the sealing means and the inner top surface of the disk-like top portion may consist out of a first material component such as PP or PE and the outer skirt of the closure and the outer surface of the disk-like top portion may consist of a second material component such as PP or PE.

A closure with a seal according to the present invention may be interconnected to a neck of a container in a different way then by threaded engagement. Suitable interconnections may be achieved by snap connections or welded connections.

DESCRIPTION OF THE DRAWINGS

The invention is explained in more detail according to the following drawings.

FIG. 26 a separated thread;

DESCRIPTION OF THE EMBODIMENTS

Corresponding features of the several shown embodiments do in general and if not indicated otherwise have corresponding reference numbers.

Figure 1:
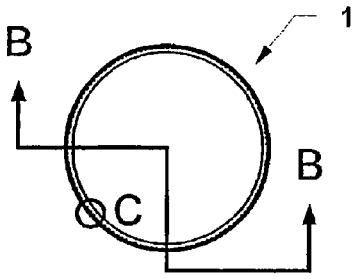
FIG. 1 shows a first embodiment of a closure in a top view.
Figure 2:
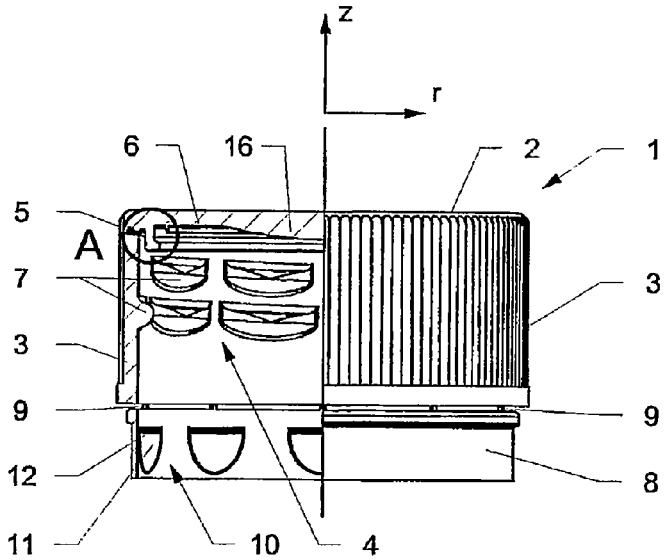
FIG. 2 shows a section view through the closure according to FIG. 1 along line BB.
Figure 5:
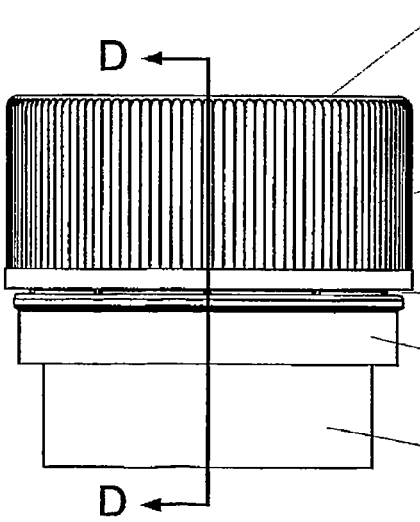
FIG. 5 shows a front view of the first embodiment on a neck of a bottle.
Figure 6:
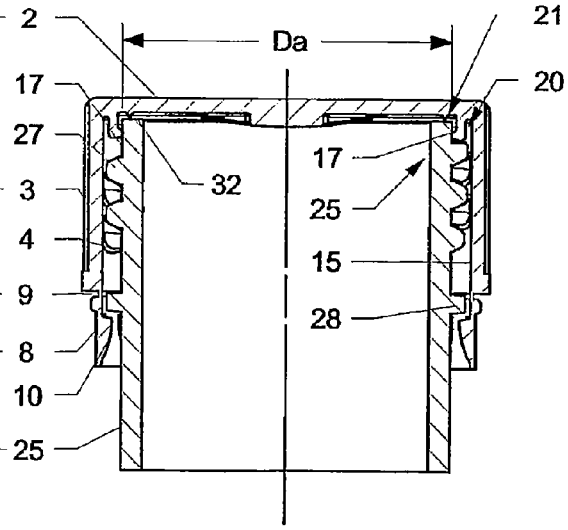
FIG. 6 shows a section view through FIG. 4 along line DD.

FIG. 1 shows a first embodiment of a screw cap closure 1 in a top view and FIG. 2 shows a section view through the same closure along line BB and FIG. 6 shows the closure 1 in a cut side view, cut along line DD of FIG. 5, while being arranged on a neck 25 of a container 26. The closure 1 comprises a disc like top portion 2, an outer skirt 3 with retaining means here in form of an internal thread 4 and a sealing means 5 in the form of a downward leg which is arranged essentially parallel to the outer skirt 3 extending perpendicular from the inner surface 6 of the top portion 2. The internal thread 4 consists out of essentially similar thread segments 7.

The shown closure comprises at its lower end a tamper evidence band 8 which is interconnected to the outer skirt 3 via bridges 9. The bridges 9 are designed such that they withstand pressure forces occurring while ejection out of a cavity of an injection mould and pop-on onto the neck of a container but break due to tension forces when initially opening of the closure by unscrewing. The bridges of the shown embodiment have essentially the shape of a frustum whereby the inner surface of the frustum arranged at the inside of the closure is aligned with the inner side surface 15 of the closure 1 such that no hindering undercut results. Alternatively or in addition scoring of the tamper band is possible.

The tamper evidence band 8 comprises here along its inside radially protruding undercut segments (barbes) 10 with an in general spherical or ellipsoidal lower part 11 and a with respect to the center axis z of the closure 1 conical upper part 12. The barbes 10 are formed such that they are suitable to be engaged with a protruding rim 28 of the neck of a container (see FIGS. 5 and 6). The shape of the lower part 11 is relevant during application of the closure onto a neck of a container (see FIGS. 5 and 6) to avoid mismatch and/or tilting. Due to the spherical shape of the lower part 11 it is achieved that the barbes 10 are contacting the neck of the container only point by point which results in less no-go. The barbes 10 and the bridges 9 are aligned to each other such the bridges 9 are directly ruptured when unscrewing the closure 1.

A herein star-shaped reinforcement element 16 extends along the inner top surface 6 of the top portion 2 of the closure. The reinforcement element 16 is designed such that the deformation of the closure 1, especially due to internal pressure (doming) is reduced.

Figure 3:
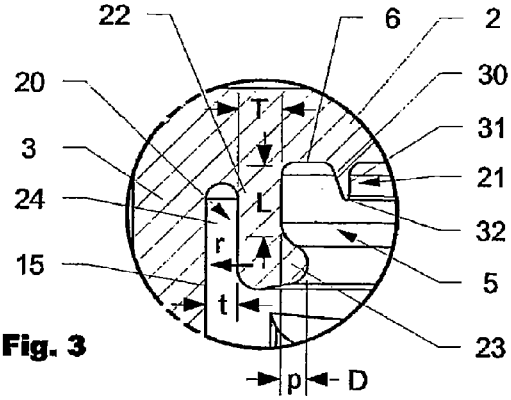
FIG. 3 shows detail A according to FIG. 1.

FIG. 3 shows detail A of FIG. 2. As it can be seen in FIG. 6, the internal thread 4 of the closure 1 is engaged with an outside thread 27 of the neck 25. The sealing means 5 comprises a side seal 20 and an in general V-shaped top seal 21 protruding from the inner surface 6 of the top portion 2 in a generally perpendicular way. The side seal 20 comprises a base 22 and an annular sealing ring 23 protruding radially inwardly suitable to seal on an outer peripheral surface 17 of the neck 25 of a container. The side seal 20 which is has here an in general P-shaped cross-section is arranged radially distanced to the outer skirt 3. In the shown embodiment an annular gap 24 with undeformed stage in general parallel side walls extends vertically between the side seal 20 and the outer skirt 3 of the closure 1 defining the outer free length of the side seal 20. The thickness t of the annular gap 24 is chosen such that the annular sealing ring 23 and the base 22 may extend, at least initially, freely in radial direction r while the closure is applied onto a neck of a bottle (examples of deformed sealing means are shown in detail in FIGS. 9 and 12). If appropriate the sealing means may controllably contact the outer skirt 3 in a later stage. The vertical length L of the base 22 of the side seal 20 is here chosen such that the annular sealing ring 23 is arranged as far as possible down along the free length of the outer vertical surface of the neck of a container in the shown embodiment just above the thread start of the container. The contact zone is on a PET-container, depending from the thread start, typically positioned about 0.5 mm to 2 mm below the annular end surface of the neck. By this arrangement the influence of doming or other deformation of the closure may be minimised such that the seal becomes over all more reliable. The laterally flexibly adjustable and vertically stiff base 22 of the side seal 20 guarantees that the annular sealing ring 23 may sideways adjust even while pop-on of the seal 20 onto a neck of a container which is eccentric, especially in radial direction. The lateral bending stiffness of the base 22 is mainly a function of the diameter D, the thickness T and the vertical length L of the of the base 22. By these parameters the lateral flexibility is adjusted to needs given. However, to improve the vertical load rating of the side seal 20 additional means may be present such as ribs (not shown in detail) arranged in gap 24 interconnecting the outer skirt 3 and the base 22 and/or the annular sealing ring 23 to each other. By this it is possible to increase the vertical collapse load while maintaining the lateral flexibility. E.g. ribs curved in radial direction are more flexible compared to ribs which are radially straight because a radial deflection load results in bending of the ribs instead of axial compression. The radial protrusion p of the annular sealing ring over its base 22 is relevant for the interference with the neck of a container. To obtain a radial sealing force the inner diameter D of the annular sealing ring 23 is smaller than the outer diameter Da of a neck of a container (see FIG. 6). If appropriate the vertical position of the neck 25 is defined by a stop element preferably arranged in the edge between the base 22 of the outer seal 20 and the inner surface 6 of the top portion 2 of closure 1. The stop element may consist of individual blocks arranged along a circular path or a single annular element. Care has to be taken that the stop element does not have a negative impact on the performance of the outer seal. It therefore may be appropriate to provide a gap extending in radial direction in between.

Top seal 21 of the shown embodiment has, with respect to the centre axis z of the closure 1 an essential conical outer surface 30 and an in general cylindrical inner surface 31 interconnected by a toroidal surface 32. The top seal 21 is, as schematically displayed in FIG. 6, designed to be engaged with an annular end section 32 of the neck 25. The top seal of the shown embodiment is made such that it preferably folds radially inward due to the conical outer 30 and cylindrical inner surface 31, when engaged with the annular end section 33 of the neck 25.

Figure 4:
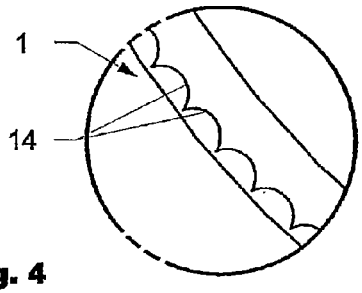
FIG. 4 shows detail C according to FIG. 1.

FIG. 4 shows detail C of FIG. 1. The shown embodiment of closure 1 comprises along the outer surface of the skirt 3 knurls 14 improving traction while applying and unscrewing of the closure 1. The shown knurls 14 have a circular cross-section helping to improve the stability of the closure while reducing the overall weight.

Figure 7:
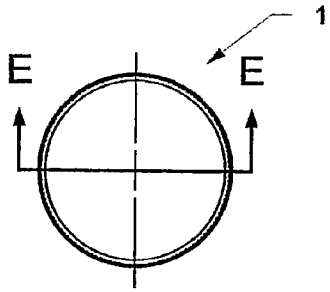
FIG. 7 shows a second embodiment of a closure in a top view.
Figure 8:
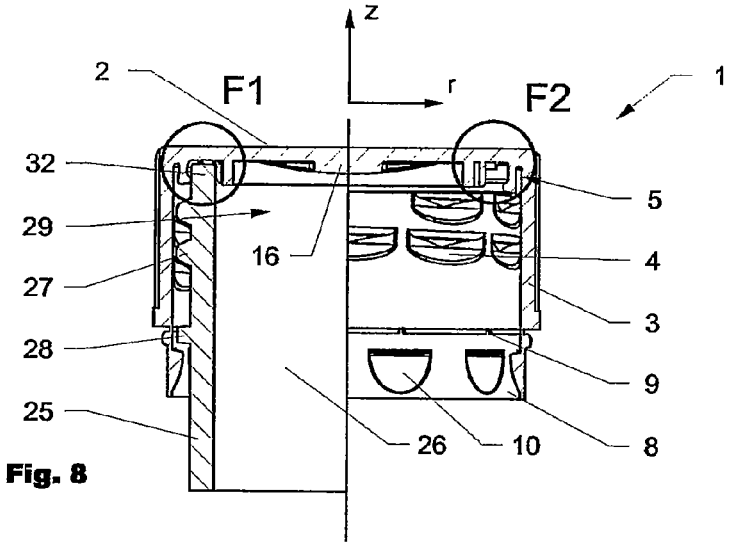
FIG. 8 shows a section view through the closure according to FIG. 6 along line EE.
Figure 9:
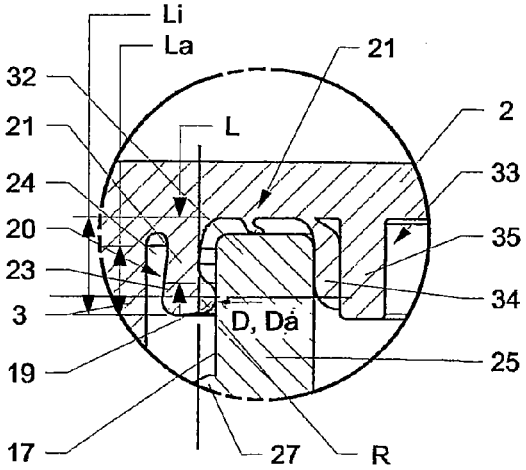
FIG. 9 shows detail F1 of FIG. 8.

FIG. 7 shows a second embodiment of a closure 1 according to the present invention in a top view and FIG. 8 shows the same closure 1 in a section view cut open along line EE of FIG. 7. Further FIG. 9 shows detail F1 and FIG. 10 detail F2 of FIG. 8. In FIG. 8, on the left hand side, the neck 25 of a container 26 is partially visible as being engaged with the closure 1. Seal 5 (detail F1) is engaged with the annular end section 32 and is therefore displayed in a deformed stage. On the right hand side of FIG. 8 neck 26 is not displayed and only closure 1 is visible. The seal 5 is therefore shown in an undeformed manner.

Figure 10:
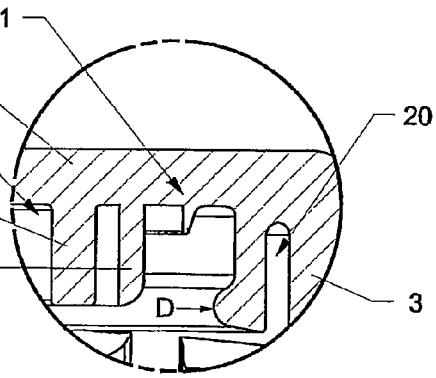
FIG. 10 shows detail F2 of FIG. 8.

As can be seen best in FIGS. 8, 9 and 10, the seal 5 comprises beside seal 20 and top seal 21 a bore seal 33 which protrudes from the inner top surface 6 of the top portion 2 into the inside of the closure 1, respectively orifice 29 of neck 25 of container 26. The bore seal 33 of the shown embodiment comprises an outer annular sealing leg 34 and an inner supporting leg 35 which supports the annular sealing leg 34 primarily radially when being engaged with the annular end section 32 of the neck 25. As displayed schematically in FIG. 9 (detail F1 of FIG. 8) the annular sealing leg 34 is deformed towards and pressed against the annular supporting leg 35. The lateral flexibility of the outside seal 20 is adjustable by the inside and the outside free length Li, La of the outside seal 20. As it can be seen the inside free length Li is bigger than the outside free length La which results in a more rigid base 21 of the outside seal 20 compared to similar free lengths Li, La. The outside seal 20 of the shown embodiment corresponds in general to the outside seal 20 of the closure 1 as shown in FIGS. 1 to 6.

As it can be seen in FIG. 9 annular-protrusion 19 of annular sealing ring 23 of outside seal 20 is pressed against the outer free peripheral surface 17 of neck 25. Thereby outside seal 20 is bent radially outwardly whereby it remains not in contact with the outer skirt 3 of the closure such that it remains flexible. The inside diameter D of the annular sealing ring 23 is expanded and corresponds in general to the outside diameter Da of the neck 25. Due to the radial expansion by the neck 25, circumferential tensile stress results in the annular sealing ring 23 and the annular base 22. Mainly due to the circumferential tensile stress in the annular sealing ring 23 the annular sealing ring 23 is pressed tightly against outer free peripheral surface 17 of the neck 25 between annular end section 32 and outside thread 27. As it can be seen outside seal 20 of the shown embodiment is designed such that even in deformed stage it becomes radially not in contact with the outer skirt 3 due to gap 24. By this design it is possible to maintain the lateral flexibility but still sealing tightly on the outside of neck 25 due to the occurring annular forces. Extensive radial support of the at least one annular sealing ring 23 may result in difficulties when demoulding of the sealing means 20. The design of gap 24 is therefore in general relevant for the proper demoulding of the annular sealing ring 23.

The length L of the base 22 of the outside seal 20 is designed such that the annular sealing ring 23 is positioned as far onto the outer free peripheral surface 17 of the neck 25 as possible. Under specific circumstances this is important to avoid failure of the seal due to deformation of the closure 1, e.g. due to internal pressure. Especially when doming of the top portion 2 of the closure 1 occurs the outer seal starts to rotate around an essentially annular axis arranged concentric to the central axis z of the closure. Meanwhile the cross-section of the outer seal 20 schematically rotates around point R. To avoid lift of the annular sealing ring 23, it is relevant that the point R is located sufficiently on to the outer free peripherals surface 17 of neck 25.

In FIG. 9 top seal 21 is shown in a deformed condition while being engaged with annular top section 32. Top seal 21 guarantees tightness mainly when the closure is under top load acting in vertical direction (parallel to z-axis), e.g. due to stacking of several containers.

Figure 11:
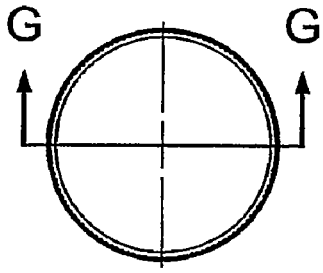
FIG. 11 shows a third embodiment of a closure in a top view.
Figure 12:
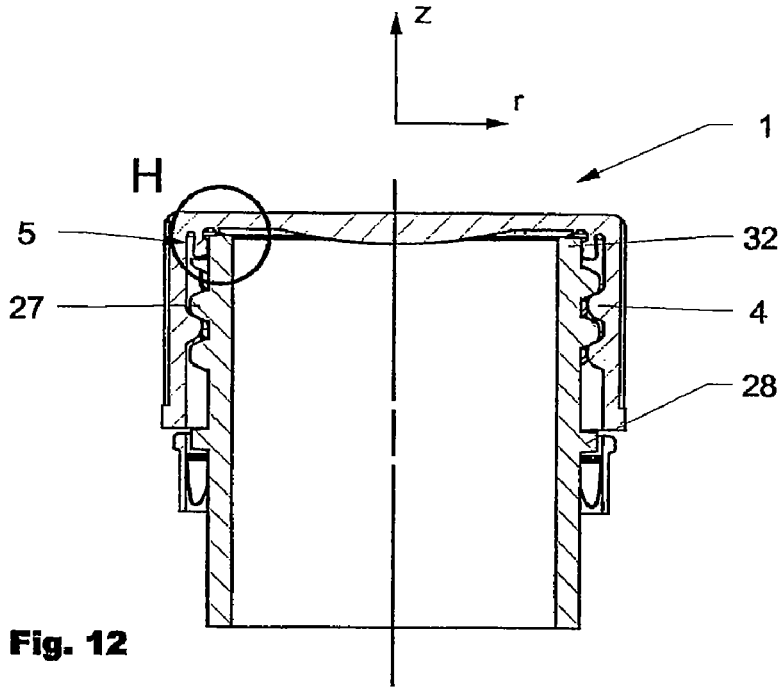
FIG. 12 shows a section view through the closure according to FIG. 9 along line GG.

FIG. 11 shows a third embodiment of a closure 1 according to the present invention engaged with the neck 25 of a container 26 in a top view. FIG. 12 shows the same closure in a section view cut along cutting line GG of FIG. 11 and FIG. 13 shows detail H of FIG. 12.

Figure 13:
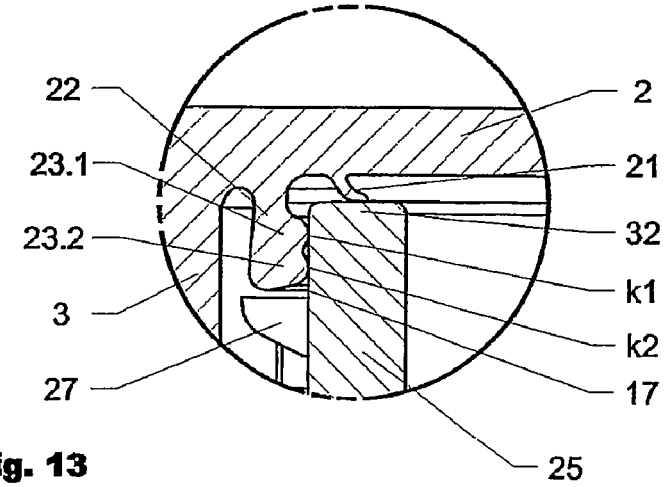
FIG. 13 shows detail H of FIG. 10.

As it can be retrieved from FIGS. 12 and 13 the seal 5 of this closure 1 comprises an outside seal 20 and a top seal 21 which are engaged with the outer free peripheral surface 17, respectively the annular end section 32 of the neck 25. The outside seal 20 comprising more than one annular sealing ring 23.1, 23.2 protruding radially inwardly. The first and the second annular sealing ring 23.1, 23.2 are arranged vertically spaced apart to each being in contact with the outer free peripheral surface 17 of the neck 25 via a first and a second contact zone k1 and k2. The shown embodiment is preferably used for containers having higher internal pressure.

Figure 14:
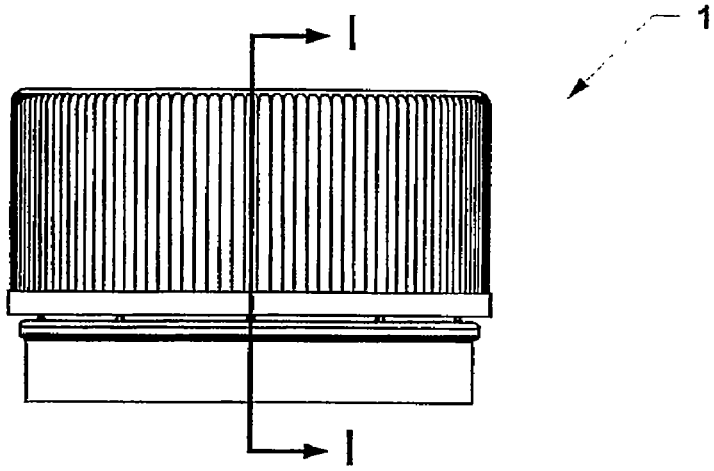
FIG. 14 shows a forth embodiment of a closure in a top view.
Figure 15:
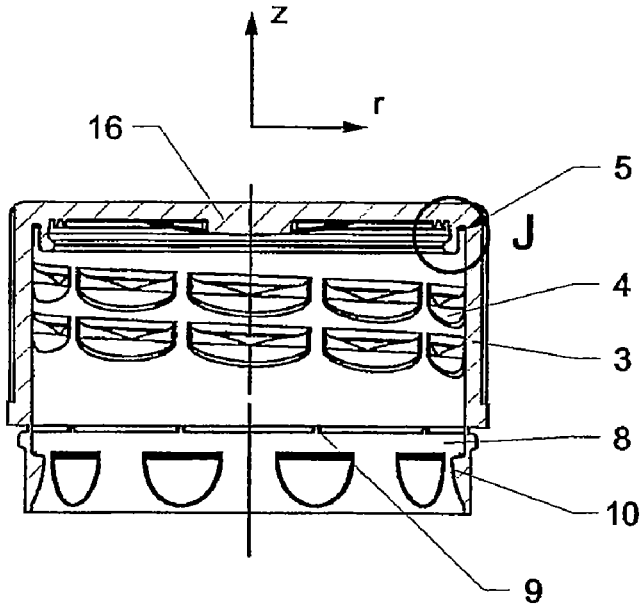
FIG. 15 shows a section view through the closure according to FIG. 12 along line 11.
Figure 16:
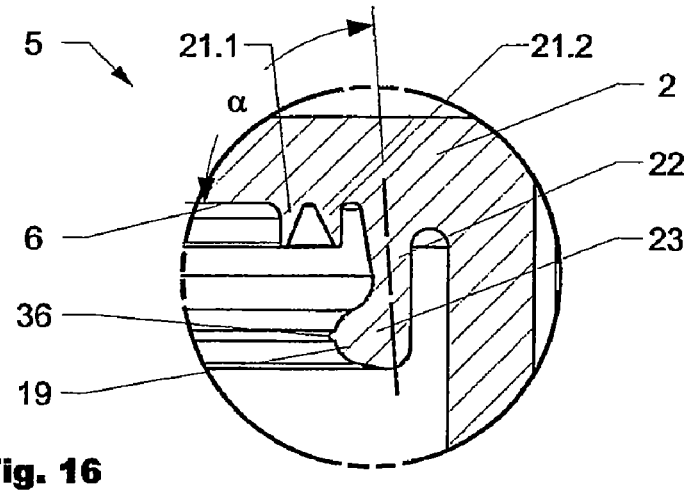
FIG. 16 shows detail J of FIG. 15.

FIG. 14 shows a fourth embodiment of a closure 1 according to the present invention in a side view. FIG. 15 shows a cut along line 11 through the closure according to FIG. 14 and FIG. 16 is showing detail J of FIG. 15 in a magnified manner. The sealing means 5 of the present embodiment has an outer seal 20 with a base 22 and an annular sealing ring 23. The annular sealing ring 23 comprises at its inner end of the radially inwardly directed annular protrusion 19 a load concentration means 36 in the form of a protruding nipple 36 which is, when the annular sealing ring 23 is engaged with the outer free peripheral surface of a neck of, a container compressed by the contraction of the annular sealing ring 23 due to radial extension. By this the sealing action may be increased. The base 22 of the outer seal 20 of the shown embodiment has a variable thickness which increases in the direction of the inner surface 6 of the top portion 2 of closure 1 and decreases in the direction of the annular sealing ring 23. As it can be seen the centre line s of the base 22 is due to this arranged at an angle $\alpha$ with respect to the top portion 2 of the closure 1.

By the shape of the base 22 it is possible to take influence on the lateral bending behaviour and elasticity. The seal 5 further comprises two concentrically arranged top seals 21.1 and 21.2 arranged opposite to each other such that the inner top seal 21.1 preferably deforms in a radial inward direction (in the direction of the closure axis z) and the outer top seal 21.2 preferably deforms in a radial outward direction when being engaged with an annular top portion of a neck of a container (not displayed in detail).

Figure 17:
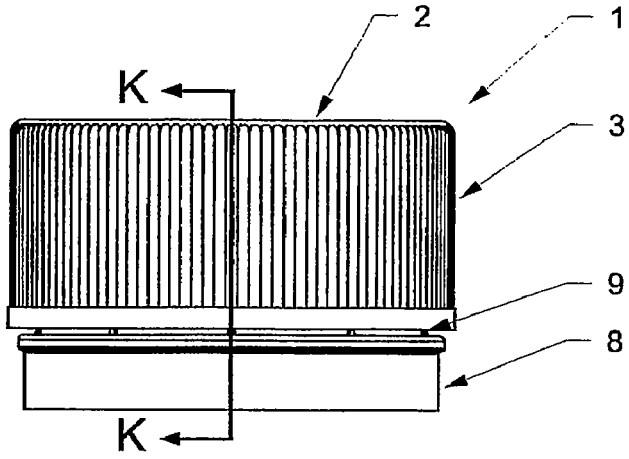
FIG. 17 shows a fifth embodiment of a closure in a top view.
Figure 18:
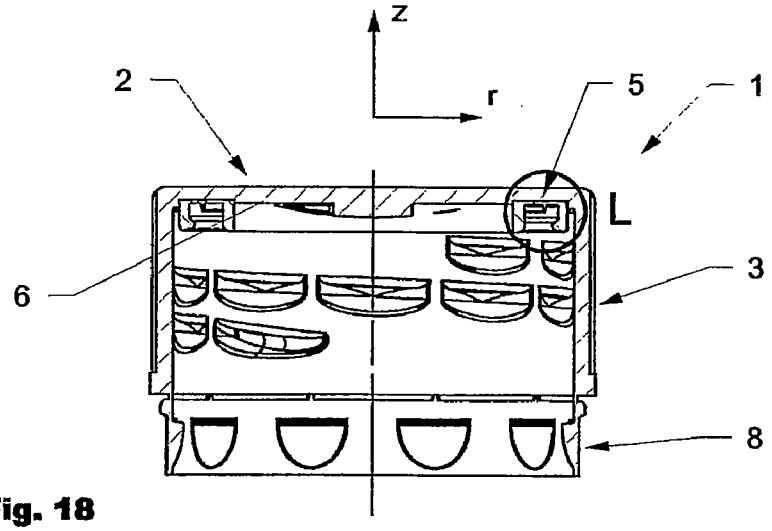
FIG. 18 shows a section view through the closure according to FIG. 17 along line KK.
Figure 19:
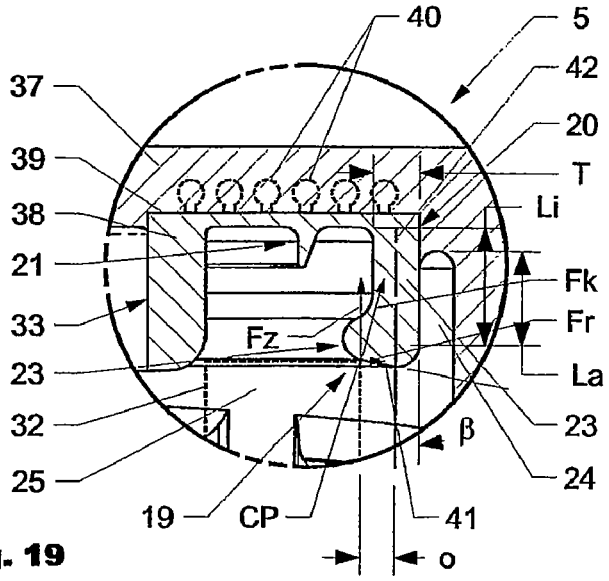
FIG. 19 shows detail L of FIG. 18.

FIG. 17 shows a fifth embodiment of a closure 1 according to the present invention in a side view, whereby FIG. 18 shows a cross-cut along line KK through closure 1 according to FIG. 17 and FIG. 19 shows detail L of FIG. 18. In difference to the previously discussed closures the present embodiment is made out of a two material components which are injected in general in a two stage procedure either in at least one cavity arranged in one mould separation plane of a injection mould or in two parallel separation planes. The top portion 2 and the outer skirt 3 are consisting of a first material component 37 while the sealing means 5 is made out of a second material component 38. As it can be seen in FIG. 19 (detail L of FIG. 18) the sealing means 5 comprises here beside an annular outer seal 20 an annular top seal 21 and an annular single legged bore seal 33 and is made of a second material component fixedly bonded/interconnected to the first material component. If appropriate the inner top surface 6 of the top portion 2 may comprise a layer of the second material component. This is important in the case that the permeability of the first material component 37 is a problem for the material stored within the container. Therefore it is possible to use a relatively low cost material for the first material component 37 and an appropriate inert material for the second material component 38. If the two material components are not bondable/connectable to each other by molecular forces, it is possible that the sealing means 5 or the outer part of the closure 1 comprise along their boundary surface 39 a mechanical joint element 40, such as mechanical undercuts, which is forming part of the cavity for the first or the second material component 37, 38 and is surrounded by the other material component forming a mechanical connection. It is further possible to adjust the flexibility of the sealing means 5 by the material used for the second material component 38. E.g. the first material component 37 which is forming the outer part of the closure 1 is made out of a rigid material component while the sealing means is made out of a softer material component which is more appropriate to tightly seal. To one ordinary skilled in the art it is clear that the shown design of the seal 5 may also be formed out of one material component. The flexibility of the base 23 of the outside seal 20 and thereby the sealing strength of the outside seal is adjustable by the inner free length Li of and the outer free length La of the outside seal 20 and their ratio.

The influence of the shape and the functionality of the outside seal 20, especially the outer annular sealing ring 23 will be explained in a general way as follows. The outside seal 20 can be used without the bore seal 23. The shape of the protrusion 19 of the annular sealing ring 23 is relevant regarding the interaction of the seal with the annular end section 32 of the neck 25 of a container. Especially the shape and the levelling of the inlet surface 41 of the outer seal 20 and the offset o of contact point CP and the centre axis 42 is relevant for the distribution of contact force Fk in radial and axial (vertical) direction Fr, Fz. While the force Fr is relevant for the deformation of the annular sealing ring in radial and its elongation in circumferential direction, the force Fz is relevant with respect the vertical compression of the base 22 in z-direction. However, offset o is of further relevance in that it causes bending of the annular sealing ring 23 and the base 22 and toroidal torque of the annular sealing ring 23. By adjusting angle β of the orientation of inlet surface 42 it is possible to influence the distribution of contact force Fk. At an angle of β=45° the Fr and Fz are equally distributed. However, the eccentricity due to the offset o has to be considered while dimensioning base 22. Depending on the field of application the offset o is in general larger then half of the average thickness T of the base 22.

Figure 20:
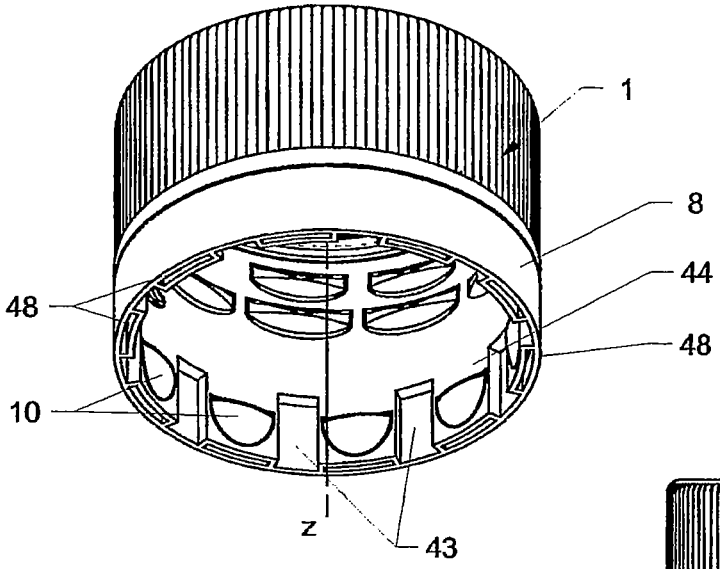
FIG. 20 shows a fifth embodiment of a closure in a perspective view.
Figure 21:
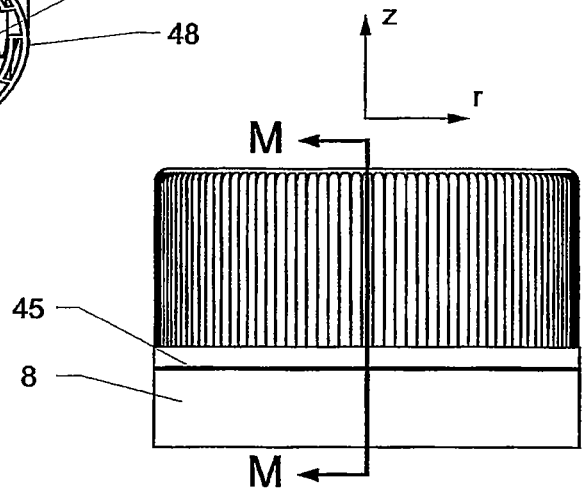
FIG. 21 shows the closure according to FIG. 20 in a front view.
Figure 22:
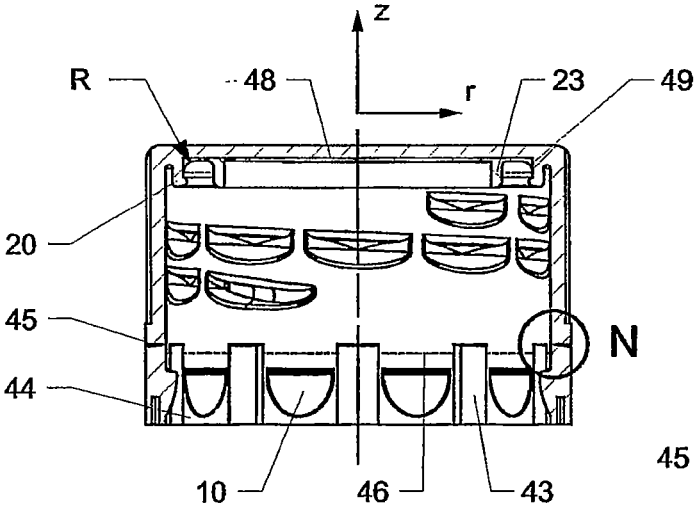
FIG. 22 shows a section view through the closure according to FIG. 21 along line MM.
Figure 23:
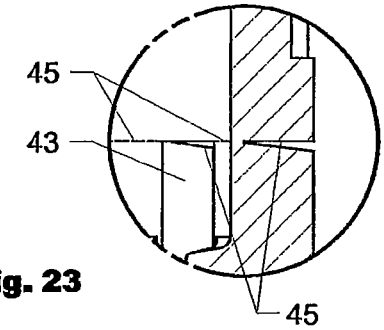
FIG. 23 shows Detail N of FIG. 22.

FIG. 20 shows a sixth embodiment of a closure according to the present invention in an isometric view. While FIG. 21 shows the closure of FIG. 20 in a side view, FIG. 22 displays a section view of the closure along line MM of FIG. 21. FIG. 23 shows detail N of FIG. 21 in a magnified manner.

While the in general P-shaped outside seal 20 is made out of the same material as the outer shell 3 of the closure 1, the bore seal 23 is made out of a liner material moulded in a separate stage. As it can be seen the inner top are of the closure 1 comprises a liner 48 which blends into the outside seal 20 by a Blend 49 having a radius R. Blend 49 is in the applied position of the closure 1 in contact with the upper outside rim of the neck of a bottle forming an outer top seal 49.

The tamper evidence band 8 of this embodiment of closure 1 has a different design than the other closures described. In general two different types of interconnections between the upper part of the closure 1 and the tamper evidence band 8 may be distinguished. A first possibility consists in that the connections between the upper part of the closure and the tamper evidence band 8 are moulded or formed by an external carving process after moulding. While the bridges 9 of the previously described embodiments are formed by injection moulding the connections of the present closure are formed by a cutting process by a carver. External carving offers the advantage of an in general simpler design of the injection mould (avoiding of sliders).

A problem of external carving is that it is difficult to control what the final result is. Due to the reason that it is important that the tamper evidence band is attached sufficiently to the upper part of the closure it is important that the closure may still be opened easily without excessive forces needed. The design of the tamper evidence band 8 comprises on its inside first recesses 43 set into the inner side surface 44 of the tamper evidence band 8. The radial depth of the recesses 43 is chosen such that the cut 45 made by the carving blade of the carving device (both not shown in detail) extends into recesses 43. Thereby it is achieved that in between the recesses 43 carved bridges 46 result which break at a controlled level adjustable by the depth of the cut 45. The recesses 43 are arranged in between the barbes 10 and are further of relevance in adjusting the lateral expansibility of the tamper evidence band. A solid band as known from prior art often causes problem due to excessive forces in the pop-on process of the closure onto the neck of a bottle. This problem is solved in that the first recesses 43 increase the lateral extensibility in a controlled manner. Recesses on the outside of the tamper evidence band are known from prior art. However beside the optical impact these solutions are more difficult in handling of the closure.

The tamper evidence band 8 of the present embodiment further comprises second recesses 48 extending from the lower annular end section 47 of the tamper evidence band 8 in vertical direction (parallel to centre axis z of the closure). The second recesses 48 allow to control the radial deflectability of the barbes 10, which is especially relevant during pop-on of the closure onto the neck of a container. If appropriate the second recesses 48 may support the forming of the carved bridges 46 in that the dept of the second recesses is chosen such that the second recesses 48 interfere with the cut 45.

Figure 24:
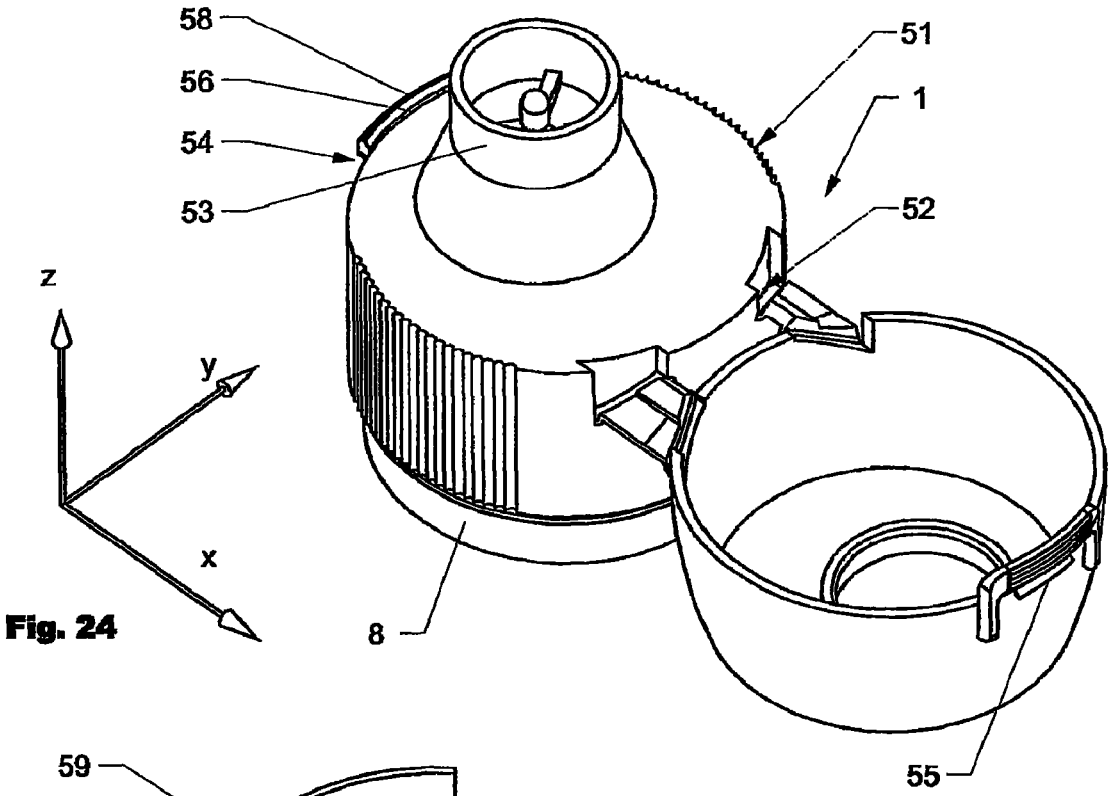
FIG. 24 shows a first embodiment of a hinged closure in a perspective view.
Figure 25:
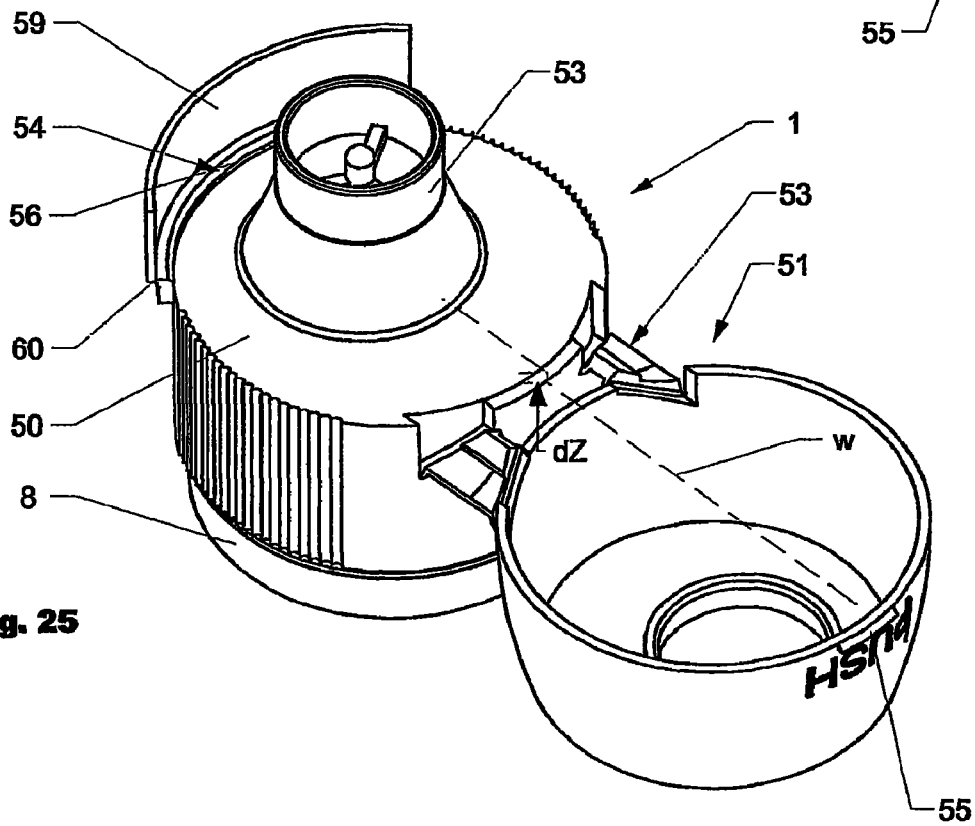
FIG. 25 shows a second embodiment of a hinged closure in a perspective view.

FIG. 24 and FIG. 25 are showing two hinged closures 1, e.g. suitable for sealing of water bottles, in an open position (as moulded) such that the base 50 and lid 51 are visible. The closures 1 are, with the exception of the tamper evidence means 54, in general similar to each other. The base 50 and the lid 51 are interconnected by a hinge 52, preferably a hinge without a main hinge connection such as e.g. known from U.S. Pat. No. 6,634,060 (from now on US'060) consisting of two torsionally rigid trapezoid elements which provide a coordinated behaviour of the closure parts 50, 51 with respect to each other while opening and closing. A hinge according to US'060 further offers the flexibility to overcome an orifice 53 which significantly protrudes over the top portion 2 of the base 50 of the closure 1. To guarantee that the lid 51 is as far away from the orifice 53 as possible the hinge 52 is designed such that the lid 51 is, in open position of the closure, arranged by the value dZ at a lower level than the top portion 2 of the base 50. The mould separation plane, schematically indicated by line w, for the shown closures 1 is in normally arranged in vertical direction (z-axis) on the level of the top portion 2 of the body 50. Due to the reason that the lid 51 is arranged at a by dZ lower level the mold separation plane may have a step in the region of the hinge 52.

The shown tamper evidence means 54 of both closures 1 are comprising at least one protruding tooth 55 standing over the outer surface of the lid 51. The tooth 55 is preferably arranged next to the mould separation plane due to the reason that in general offers a more simple mould design. The at least one tooth 55 engages while closing of the closure 1 with notch 56 arranged in general opposite to the hinge 52 on body 50. To disengage tooth 55 and notch 56 such that the lid 51 can be opened the front of lid 51 has to be pressed inwardly (in FIG. 24 indicated by PUSH) in the general direction of the centre axis of the closure. Prior to first time opening of the closure as shown in FIG. 23 it is necessary to break of shackle 57 which is designed such that it engages with nose 58 while first time closing of the closure 1 after moulding but is destroyed during initial opening of the closure. While the combination of shackle 57 and nose 58 serve as a mean for indicating initial opening of the closure the combination of tooth 55 and notch 56 may be used as lock which prevents unwanted opening. The closure 1 shown in FIG. 24 lacks the combination of shackle 57 and nose 58 as shown in FIG. 23. Instead it is necessary to tear off a tear of lip 59 by destroying breaking member 60 unless it is possible to manually disengage tooth 55 and notch 56. To increase safety it is possible to combine additional locking/tamper evidence means. The shown closures are e.g. suitable for carbonized beverages.

As it can be seen tooth 55, notch 56, shackle 57, nose 58 and tear of lip 59 are arranged outside the main contour of the body 50 and the lid 51. This offers the advantage that they are accessible in the mould in vertical direction (z-direction) such that sliders or shifting elements may be avoided.

Figure 27:
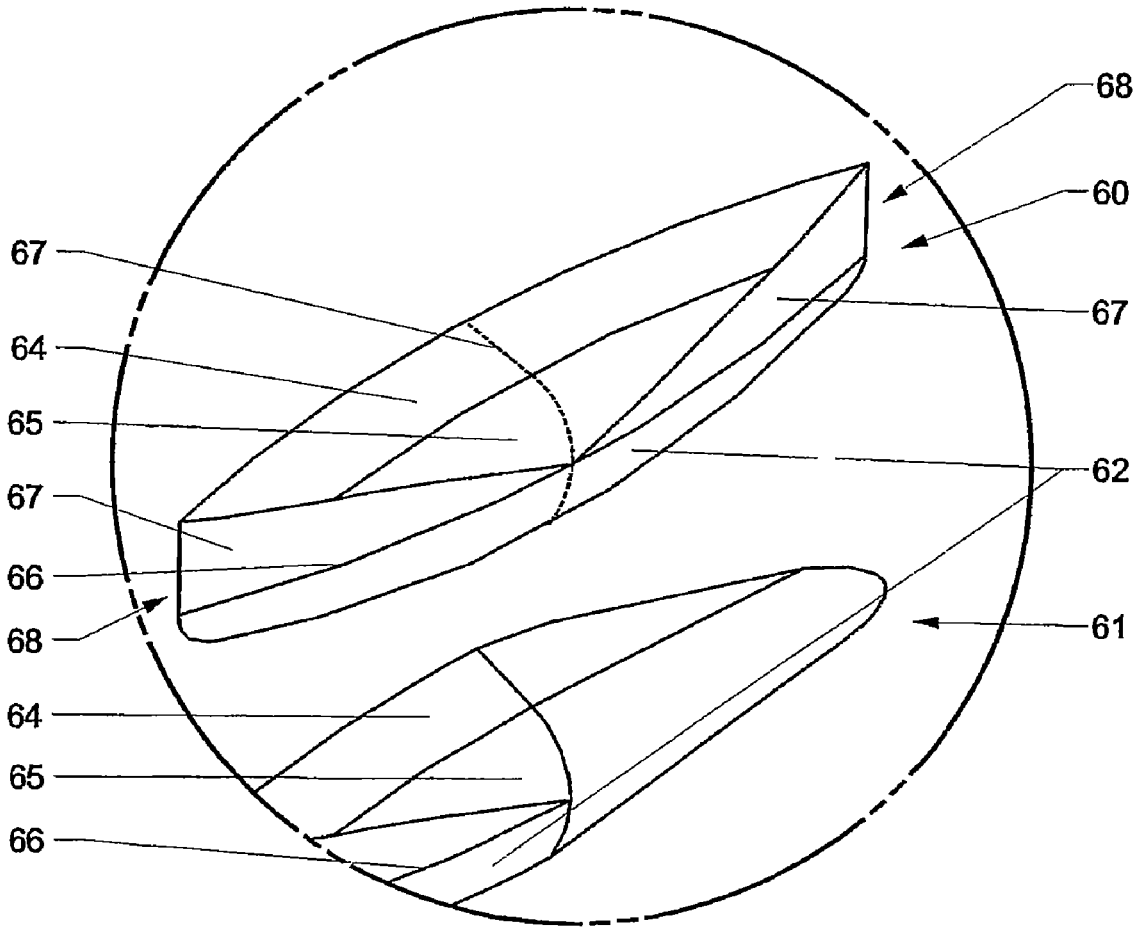
FIG. 27 shows two thread segments (detail O of FIG. 26).

FIG. 26 shows a preferred embodiment of an internal thread 4 as it may be incorporated in the closures as described herein in an isolated cut out view. FIG. 27 shows a single thread segment 60 in a magnified manner. As it is visible to thread consists out of single segments 60 which are aligned to each other along a thread path 62 on radius r around centre axis z. The first segment 61 on the start of the thread is formed such that it easily engages with the thread of the neck of a closure. The segments 60 of the thread 4 in general are having an essentially frusto conical/prolate ellipsoidal bottom 63 and an essentially conically shaped top 64 which is interconnected to the bottom by essentially toroidal connecting surface 65. Thereby a vertical cross section through a segment 60 would in general have a circular shape (indicated by line 66) which results in a general cylindrical outer shape 67.

The thread 4 is designed such that failure of the seal due to mismatch of the closure while pop on to the neck of the container becomes more unlikely compared to closures with threads known from prior art. To obtain good distribution of load it is advantageous that the segments 60 of the thread 4 interact with the thread of a neck of a container two-dimensionally. The effect of the in general frusto conical shape of the bottom 63 of the segments 60 is that during application of the closure onto the thread of the neck of a container the contact between the segments 60 of the thread 4 and the thread of the neck of the bottle is, due to the specific bottom shape of the segments 60 of the thread 4, primarily at distinct interaction points (schematically indicated by line 67). A further advantage is that drag during application is reduced. Looking at a radial cross section of a segment of the thread of the closure, the cross section comprises an essentially arch-shaped bottom 66 and an essentially straight top 64. The transitions from one segment of the cross section into another are preferably floating without sharp edges. The dilation of the cross sections of the segments of the thread is in general maximal about the middle of the length of each segment 60 and is reduced versus its ends 68.

It is obvious that one skilled in the art is capable to find further embodiments of the present invention by the combination of features of the herein described preferred embodiments.

The invention claimed is:

1. Closure for sealing of an orifice of a neck of a container comprising:
- a top portion;
- an outer skirt; and
- a sealing means, said sealing means comprising:
  - a radially deformable outer sealing means suitable to be engaged with an outer free peripheral surface of said neck, whereby said outer sealing means comprises:
    - an annular base radially distanced to said outer skirt by a gap; and
    - at least one annular sealing ring protruding radially inwardly from said base to form, when applied onto the neck of the container, a contact zone with an outer free surface of said neck positioned between 0.5 mm to 2 mm below the annular end surface of the neck.

2. Closure according to claim 1, wherein the sealing means is radially freestanding when applied onto the neck of the container.

3. Closure according to claim 1, wherein the inside and the outside free length of the outer sealing means are equal.

4. Closure according to claim 1, wherein the outside free length of the outer sealing means is shorter than its inside free length.

5. Closure according to claim 1, wherein the base is arranged in general perpendicular to the top portion.

6. Closure according to claim 1, wherein said base has a constant thickness.

7. Closure according to claim 1 wherein said base has a variable thickness.

8. Closure according to claim 1, wherein the outer sealing means comprises two vertically distanced annular sealing rings.

9. Closure according to claim 1, wherein the sealing means further comprises at least one annular top seal.

10. Closure according to claim 9, wherein the top seal has a symmetric V-shape or an asymmetric V-shape with a first cylindrical and a second conical surface.

11. Closure according to claim 1, wherein the sealing means further comprises a bore seal arranged radially distanced to the outer sealing means.

12. Closure according to claim 11, wherein the bore seal comprises an inner supporting and an outer sealing leg.

13. Closure according to claim 1, wherein the outer sealing means is made at least partially out of a different material then the outer skirt of the closure.

14. Closure according to claim 2, wherein the outside free length of the outer sealing means is shorter than its inside free length.

15. Closure according to claim 2, wherein said base has a variable thickness.

16. Closure according to claim 1, wherein the sealing means comprises a blend having a radius R, said blend forming an outer top seal when applied onto the neck of a container.

* * * * *